US011378275B2

(12) United States Patent
Locke et al.

(10) Patent No.: US 11,378,275 B2
(45) Date of Patent: Jul. 5, 2022

(54) HIGH SHEAR SWIRLER WITH RECESSED FUEL FILMER FOR A GAS TURBINE ENGINE

(71) Applicant: United Technologies Corporation, Farmington, CT (US)

(72) Inventors: Justin M. Locke, Tolland, CT (US); Timothy S. Snyder, Glastonbury, CT (US); William Proscia, Marlborough, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 72 days.

(21) Appl. No.: 16/705,547

(22) Filed: Dec. 6, 2019

(65) Prior Publication Data

US 2021/0172604 A1 Jun. 10, 2021

(51) Int. Cl.

| | |
|---|---|
| ***F23R 3/28*** | (2006.01) |
| ***F23R 3/14*** | (2006.01) |
| ***F23R 3/30*** | (2006.01) |

(52) U.S. Cl.

CPC ..... *F23R 3/14* (2013.01); *F23R 3/283* (2013.01); *F23R 3/286* (2013.01); *F23R 3/30* (2013.01)

(58) Field of Classification Search

CPC ..... F23R 3/14; F23R 3/286; F23R 3/30

See application file for complete search history.

(56) References Cited

U.S. PATENT DOCUMENTS

| | | | | |
|---|---|---|---|---|
| 4,070,826 A | | 1/1978 | Stenger | |
| 4,257,236 A | | 3/1981 | Morishita | |
| 4,653,278 A | * | 3/1987 | Vinson | F23C 7/004 60/737 |
| 4,842,197 A | * | 6/1989 | Simon | F23C 7/002 239/400 |
| 4,854,127 A | | 8/1989 | Vinson | |
| 5,373,693 A | * | 12/1994 | Zarzalis | F23C 7/006 60/39.23 |
| 5,417,070 A | * | 5/1995 | Richardson | F23C 7/004 239/406 |
| 5,444,982 A | * | 8/1995 | Heberling | F23D 11/441 60/737 |
| 5,490,378 A | * | 2/1996 | Berger | F23C 7/00 60/39.23 |

(Continued)

OTHER PUBLICATIONS

EP search report for EP20212215.6 dated May 3, 2021.

*Primary Examiner* — William H Rodriguez
(74) *Attorney, Agent, or Firm* — Getz Balich LLC

(57) ABSTRACT

An assembly is provided for a turbine engine. This assembly includes a swirler and a fuel nozzle. The swirler is configured with an outer wall, an inner wall, an outer passage and an inner passage. The outer wall circumscribes the inner wall and extends axially along an axis to a distal outer wall end. The inner wall extends axially along the axis to a distal inner wall end that is axially recessed within the swirler from the distal outer wall end. The outer passage is formed by and radially between the inner wall and the outer wall. The inner passage is formed by and radially within the inner wall. The fuel nozzle projects into the inner passage. The fuel nozzle is configured with a plurality of orifices axially aligned with the inner wall and arranged circumferentially about the axis.

13 Claims, 9 Drawing Sheets

(56) References Cited

U.S. PATENT DOCUMENTS 5,505,045 A * 4/1996 Lee ..... F23D 11/107 239/424
5,941,075 A * 8/1999 Ansart ..... F23R 3/14 60/737
5,966,937 A * 10/1999 Graves ..... F23C 7/004 239/400
5,987,889 A * 11/1999 Graves ..... F23C 7/004 60/746
6,035,645 A * 3/2000 Bensaadi ..... F23R 3/14 60/742
6,151,899 A 11/2000 Park
6,367,262 B1 * 4/2002 Mongia ..... F23R 3/343 60/748
7,334,410 B2 * 2/2008 Creighton ..... F23R 3/14 60/772
9,068,749 B2 6/2015 Cheung
10,094,352 B2 10/2018 Buelow
10,317,081 B2 6/2019 Hoke
10,344,981 B2 * 7/2019 Prociw ..... F23R 3/14
10,393,030 B2 8/2019 Proscia
2003/0010034 A1 * 1/2003 Baudoin ..... F23R 3/286 60/740
2003/0131600 A1 * 7/2003 David ..... F23R 3/14 60/737
2004/0065090 A1 * 4/2004 Al-Roub ..... F23R 3/14 60/776
2005/0039458 A1 * 2/2005 Leen ..... F23R 3/14 60/748
2005/0223710 A1 * 10/2005 Creighton ..... F23R 3/28 60/740
2007/0289306 A1 * 12/2007 Suria ..... F23R 3/14 60/748
2009/0049840 A1 * 2/2009 Cayre ..... F23R 3/28 60/748
2009/0151357 A1 * 6/2009 Pieussergues ..... F23R 3/14 60/737
2011/0000216 A1 * 1/2011 Imamura ..... F23R 3/60 60/748
2011/0271680 A1 * 11/2011 Bagchi ..... F23R 3/28 60/737
2012/0304650 A1 * 12/2012 Hernandez ..... F23R 3/343 60/737
2013/0020413 A1 * 1/2013 Jones ..... F23R 3/343 239/533.2
2014/0165578 A1 * 6/2014 Burd ..... F02G 3/00 60/772
2014/0165585 A1 * 6/2014 Burd ..... F23R 3/12 60/776
2014/0241871 A1 * 8/2014 Gregory ..... F01D 9/02 415/208.1
2014/0246518 A1 * 9/2014 Myers ..... F23R 3/14 239/406
2015/0052899 A1 * 2/2015 Toon ..... F23R 3/286 60/746
2016/0033130 A1 2/2016 Low
2016/0209037 A1 * 7/2016 Dai ..... F23R 3/286
2016/0231000 A1 8/2016 Sadil
2016/0252252 A1 * 9/2016 Dai ..... F23D 17/002 60/740
2016/0290291 A1 * 10/2016 Prociw ..... F02C 7/22
2016/0290649 A1 * 10/2016 Prociw ..... F23R 3/14
2017/0003029 A1 * 1/2017 Mook ..... F23R 3/14
2018/0003385 A1 * 1/2018 Rodrigues ..... F23R 3/286
2018/0156450 A1 * 6/2018 Doerr ..... F02C 7/222
2018/0238548 A1 * 8/2018 Buelow ..... F23R 3/14
2018/0335214 A1 * 11/2018 Strickland ..... F23R 3/002
2019/0024896 A1 * 1/2019 Porter ..... F23R 3/14
2019/0032559 A1 1/2019 Dai
2019/0056108 A1 2/2019 Li
2019/0093896 A1 * 3/2019 Clemen ..... F23R 3/14
2019/0170354 A1 * 6/2019 Resvanis ..... F23R 3/14
2019/0376689 A1 * 12/2019 Guezel ..... F23R 3/283
2020/0025386 A1 * 1/2020 Muldal ..... F02K 9/50
2020/0041128 A1 * 2/2020 Benjamin ..... F23R 3/286
2020/0248903 A1 * 8/2020 Sampath ..... F23R 3/286

* cited by examiner

HIGH SHEAR SWIRLER WITH RECESSED FUEL FILMER FOR A GAS TURBINE ENGINE

BACKGROUND OF THE DISCLOSURE

1. Technical Field

This disclosure relates generally to a fuel injector assembly and, more particularly, to a fuel injector assembly with a high shear swirler.

2. Background Information

Various types and configurations of fuel injector assemblies are known in the art. Some of these known fuel injector assemblies include a high shear swirler mated with a fuel injector nozzle. While these known fuel injector assemblies have various advantages, there is still room in the art for improvement. In particular, there is still room in the art for fuel injector assemblies capable of improving fuel-air mixing, reducing combustor dynamics and/or reducing undesirable combustor tones.

SUMMARY OF THE DISCLOSURE

According to an aspect of the present disclosure, an assembly is provided for a turbine engine. This turbine engine assembly includes a swirler and a fuel nozzle. The swirler is configured with an outer wall, an inner wall, an outer passage and an inner passage. The outer wall circumscribes the inner wall and extends axially along an axis to a distal outer wall end. The inner wall extends axially along the axis to a distal inner wall end that is axially recessed within the swirler from the distal outer wall end. The outer passage is formed by and radially between the inner wall and the outer wall. The inner passage is formed by and radially within the inner wall. The fuel nozzle projects into the inner passage. The fuel nozzle is configured with a plurality of orifices axially aligned with the inner wall and arranged circumferentially about the axis.

According to another aspect of the present disclosure, a fuel injector assembly with an axis is provided. This fuel injector assembly includes a swirler and a fuel nozzle. The swirler is configured with an outer wall, an inner wall, an outer passage and an inner passage. The outer wall extends axially along the axis to a distal outer wall end. The inner wall is radially within the outer wall and extends axially along the axis to a distal inner wall end. The distal inner wall end is axially offset from the distal outer wall end along the axis. The outer passage is radially between the inner wall and the outer wall. The inner passage is radially within the inner wall. The fuel nozzle projects into the inner passage. The fuel nozzle is configured to direct a plurality of jets of fuel against the inner wall.

According to still another aspect of the present disclosure, another fuel injector assembly with an axis is provided. This fuel injector assembly includes a swirler and a fuel nozzle. The swirler is configured with an outer wall, an inner wall, an outer passage and an inner passage. The outer wall extends circumferentially about the inner wall and extends axially along the axis to a distal outer wall end. The inner wall extends axially along the axis to a distal inner wall end. The outer passage is radially between the inner wall and the outer wall. The inner passage is radially within the inner wall. The fuel nozzle projects into the inner passage. The distal outer wall end is disposed a first distance along the axis from a tip of the fuel nozzle. The distal outer wall end is disposed a second distance along the axis from the distal inner wall end. The outer passage has a diameter at the distal outer wall end. A quotient of (the first distance minus the second distance) divided by the diameter is less than one.

The plurality of orifices may include a first orifice that is configured to direct a jet of fuel to impinge against the inner wall.

The fuel nozzle may be further configured with a second orifice that is coaxial with the axis.

The distal outer wall end may be disposed a first distance along the axis from a tip of the fuel nozzle. The distal outer wall end may be disposed a second distance along the axis from the distal inner wall end. The outer passage may have a diameter at the distal outer wall end. A quotient of (the first distance minus the second distance) divided by the diameter may be less than one.

The quotient may be less than or equal to 0.8.

The quotient may be greater than or equal to 0.25.

The quotient may be between 0.35 and 0.68; e.g., $0.35 \leq \text{quotient} \leq 0.68$.

The distal outer wall end may be disposed a distance along the axis from a tip of the fuel nozzle. The outer passage may have a diameter at the distal outer wall end. A quotient of the distance divided by the diameter may be less than one.

The quotient may be between 0.5 and 0.75; e.g., $0.5 \leq \text{quotient} \leq 0.75$.

The distal outer wall end may be disposed a first distance along the axis from a tip of the fuel nozzle. The distal outer wall end may be disposed a second distance along the axis from the distal inner wall end. The outer passage may have a diameter at the distal outer wall end. A quotient of the second distance divided by the diameter may be between 0.07 and 0.15; e.g., $0.07 \leq \text{quotient} \leq 0.15$.

The swirler may include a first set of vanes and a second set of vanes. The first set of vanes may be arranged with the outer passage. The second set of vanes may be arranged with the inner passage.

The swirler may further include a third set of vanes arranged with the inner passage. The third set of vanes may be axially offset from the second set of vanes.

A nozzle guide plate may be included that mounts the fuel nozzle to the swirler.

The distal inner wall end may be located axially between the distal outer wall end and a tip of the fuel nozzle along the axis.

The fuel nozzle may be configured with a plurality of orifices that are axially overlapped by the inner wall and arranged circumferentially about the axis.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
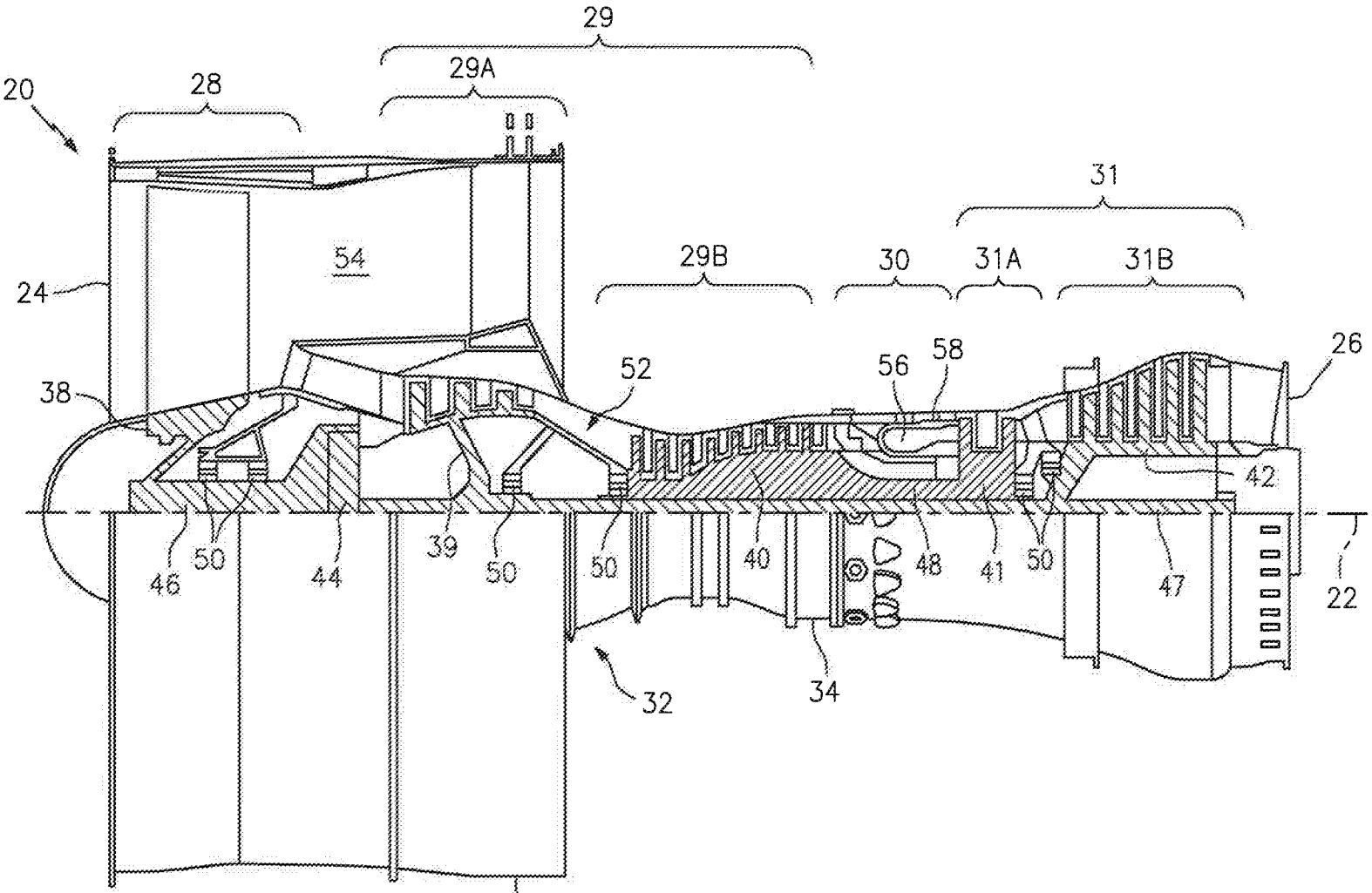
FIG. 1 is a side cutaway illustration of a geared turbine engine.

FIG. 1 is a side cutaway illustration of a geared turbine engine 20. This turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28, 29A, 29B, 30, 31A and 31B are arranged sequentially along the centerline 22 within an engine housing 32. This housing 32 includes an inner case 34 (e.g., a core case) and an outer case 36 (e.g., a fan case). The inner case 34 may house one or more of the engine sections 29A-31B; e.g., an engine core. The outer case 36 may house at least the fan section 28.

Each of the engine sections 28, 29A, 29B, 31A and 31B includes a respective rotor 38-42. Each of these rotors 38-42 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 38 is connected to a gear train 44, for example, through a fan shaft 46. The gear train 44 and the LPC rotor 39 are connected to and driven by the LPT rotor 42 through a low speed shaft 47. The HPC rotor 40 is connected to and driven by the HPT rotor 41 through a high speed shaft 48. The shafts 46-48 are rotatably supported by a plurality of bearings 50; e.g., rolling element and/or thrust bearings. Each of these bearings 50 is connected to the engine housing 32 by at least one stationary structure such as, for example, an annular support strut.

During operation, air enters the turbine engine 20 through the airflow inlet 24. This air is directed through the fan section 28 and into a core gas path 52 and a bypass gas path 54. The core gas path 52 extends sequentially through the engine sections 29A-31B. The air within the core gas path 52 may be referred to as "core air". The bypass gas path 54 extends through a bypass duct, which bypasses the engine core. The air within the bypass gas path 54 may be referred to as "bypass air".

The core air is compressed by the compressor rotors 39 and 40 and directed into an annular combustion chamber 56 of a combustor 58 in the combustor section 30. Fuel is injected into the combustion chamber 56 and mixed with the compressed core air to provide a fuel-air mixture. This fuel air mixture is ignited and combustion products thereof flow through and sequentially cause the turbine rotors 41 and 42 to rotate. The rotation of the turbine rotors 41 and 42 respectively drive rotation of the compressor rotors 40 and 39 and, thus, compression of the air received from a core airflow inlet. The rotation of the turbine rotor 42 also drives rotation of the fan rotor 38, which propels bypass air through and out of the bypass gas path 54. The propulsion of the bypass air may account for a majority of thrust generated by the turbine engine 20, e.g., more than seventy-five percent (75%) of engine thrust. The turbine engine 20 of the present disclosure, however, is not limited to the foregoing exemplary thrust ratio.

Figure 2:
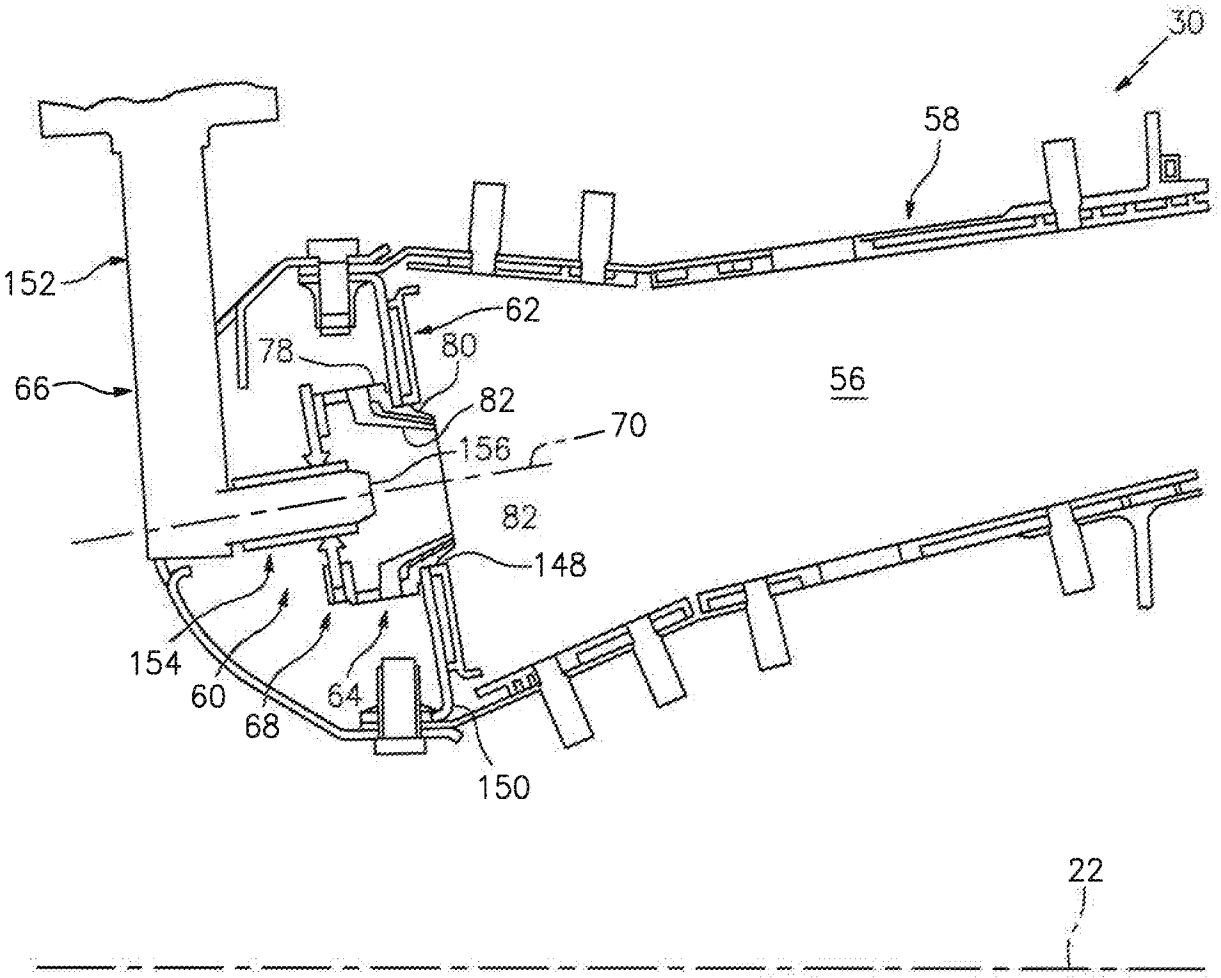
FIG. 2 is a partial side sectional illustration of a combustor section.

Referring to FIG. 2, the combustor section 30 includes a plurality of fuel injector assemblies 60 (one visible in FIG. 2) arranged circumferentially about the centerline 22 in an annular array. The fuel injector assemblies 60 are mounted to an annular bulkhead 62 of the combustor 58. The fuel injector assemblies 60 are configured to direct a mixture of fuel and compressed air into the combustion chamber 56 for combustion.

Each fuel injector assembly 60 includes a high shear swirler 64 and a fuel injector 66. The fuel injector assembly 60 of FIG. 2 also includes a mount 68 configured to couple the fuel injector 66 to the swirler 64.

Figure 3:
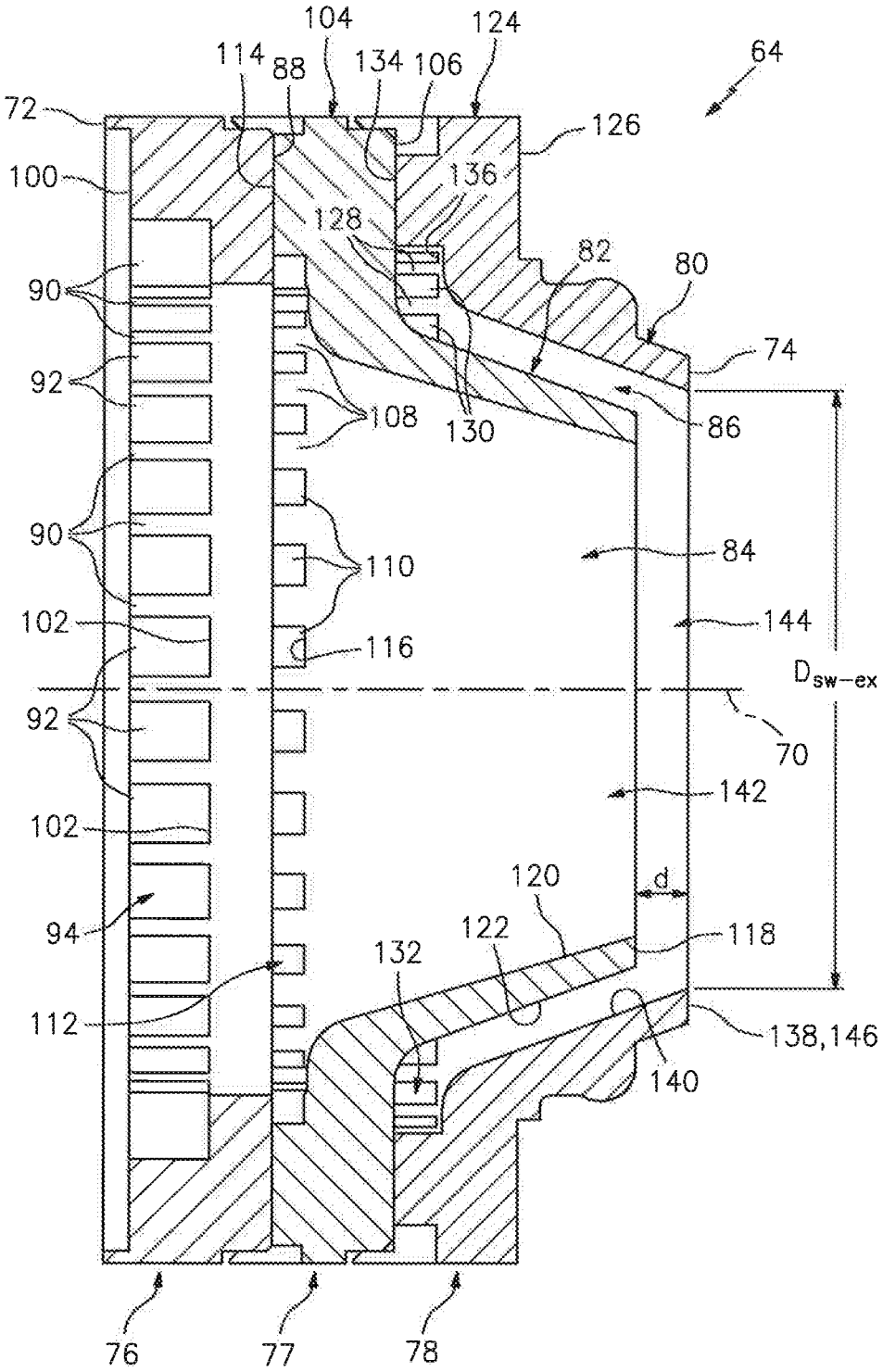
FIG. 3 is a side sectional illustration of a swirler.

Referring to FIG. 3, the swirler 64 extends circumferentially around an axis 70 (e.g., a centerline of the swirler 64) thereby providing the swirler 64 with a full hoop body. The swirler 64 extends axially along the axis 70 between a swirler upstream end 72 and a swirler downstream end 74.

The swirler 64 of FIG. 3 includes an upstream swirler segment 76, a flanged intermediate swirler segment 77 and a flanged downstream swirler segment 78. These swirler segments 76-78 configure the swirler 64 with a tubular swirler outer wall 80, a tubular swirler inner wall 82 (e.g., a fuel filmer) and a plurality of swirler passages 84 and 86.

The upstream swirler segment 76 extends circumferentially around the axis 70. The upstream swirler segment 76 is located at (e.g., on, adjacent or proximate) the swirler upstream end 72. The upstream swirler segment 76 of FIG. 3, for example, extends axially along the axis 70 from the swirler upstream end 72 to an annular upstream swirler segment surface 88.

Figure 4A:
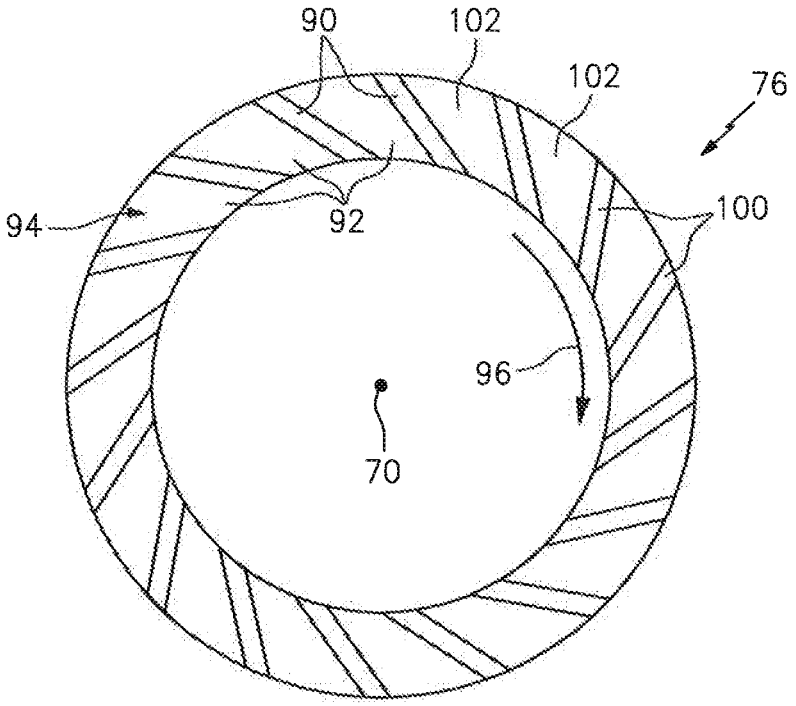
FIG. 4A is an end view illustration of an upstream swirler segment of the swirler with vanes arranged in a first circumferential direction.
Figure 4B:
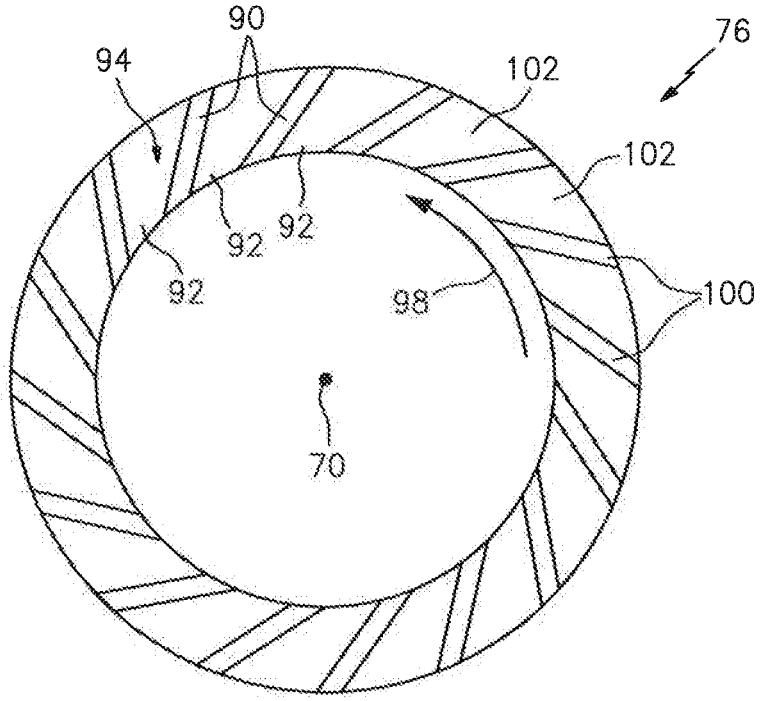
FIG. 4B is an end view illustration of the upstream swirler segment with the vanes arranged in a second circumferential direction.

Referring to FIG. 4A, the upstream swirler segment 76 is configured with an upstream set of vanes 90. These upstream vanes 90 are arranged circumferentially around the axis 70 in an annular array. Each upstream vane 90 is circumferentially separated from each circumferentially adjacent (e.g., neighboring) upstream vane 90 by a respective air gap 92. The gaps 92 collectively form an upstream airflow inlet 94 into the swirler 64 at the swirler upstream end 72; see also FIG. 3. The upstream vanes 90 may be configured such that air entering the swirler 64 through the upstream airflow inlet 94 generally flows in a first circumferential direction 96 (e.g., a clockwise direction) about the axis 70. Alternatively, referring to FIG. 4B, the upstream vanes 90 may be configured such that air entering the swirler 64 through the upstream airflow inlet 94 generally flows in a second circumferential direction 98 (e.g., a counterclockwise direction) about the axis 70.

In the specific embodiment of FIG. 3, the upstream vanes 90 are arranged at the swirler upstream end 72. With this arrangement, each gap 92 may extend partially axially into the upstream swirler segment 76 from a castellated surface 100 of the segment 76 at the swirler upstream end 72 to a gap end surface 102. Of course, in other embodiments, each gap 92 may be formed completely axially within the swirler 64 and, for example, its upstream swirler segment 76.

The intermediate swirler segment 77 includes an annular intermediate swirler segment base 104 (e.g., a radial flange) and the swirler inner wall 82. The intermediate swirler segment 77 and each of its components 82 and 104 extends circumferentially around the axis 70.

The intermediate swirler segment base 104 is abutted axially against the upstream swirler segment 76. The intermediate swirler segment base 104, for example, may be coupled (e.g., bonded to) the upstream swirler segment surface 88. The intermediate swirler segment base 104 extends axially along the axis 70 from the upstream swirler segment 76 to an annular intermediate swirler segment surface 106.

Figure 5A:
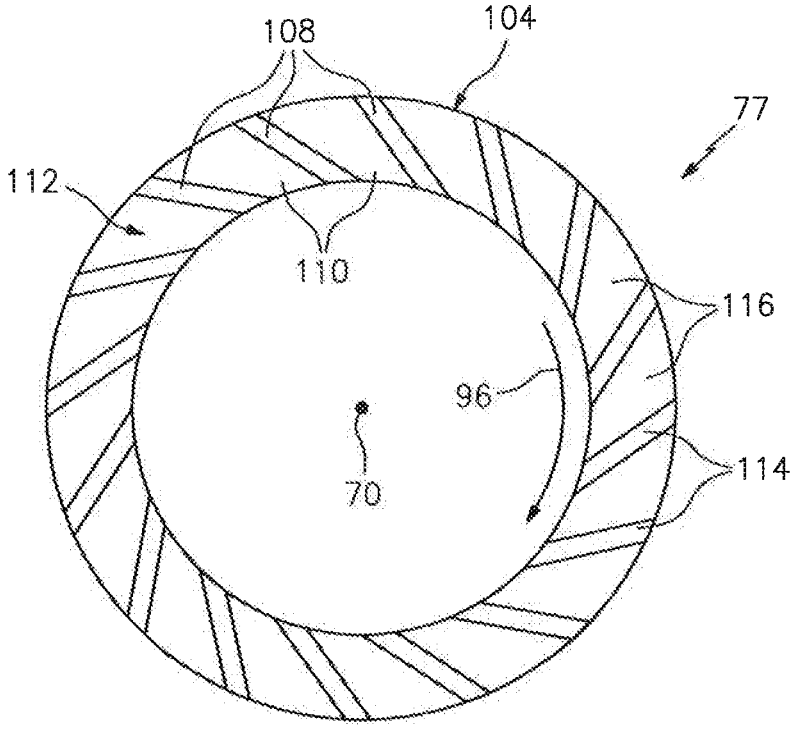
FIG. 5A is an end view illustration of an intermediate swirler segment of the swirler with vanes arranged in the first circumferential direction.
Figure 5B:
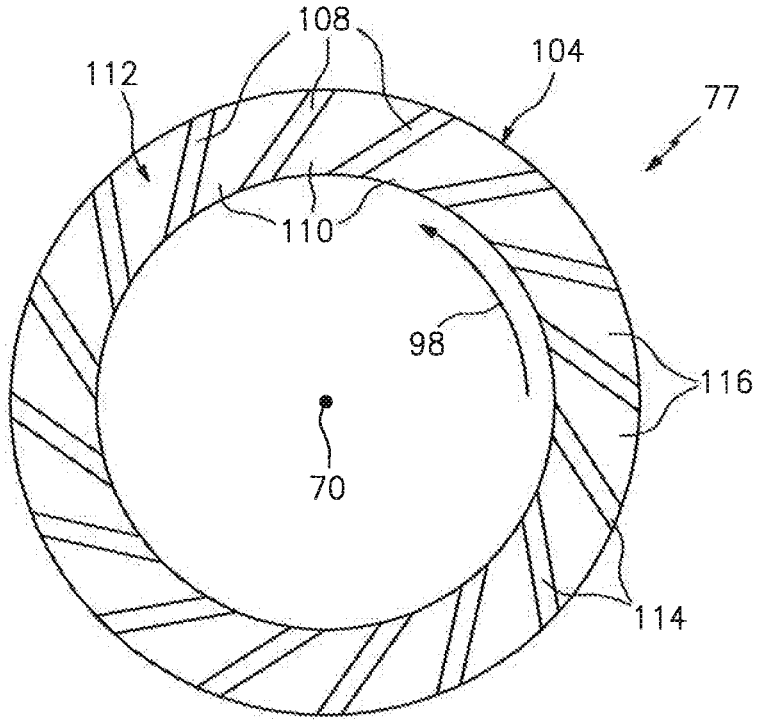
FIG. 5B is an end view illustration of the intermediate swirler segment with the vanes arranged in the second circumferential direction.

Referring to FIG. 5A, the intermediate swirler segment base 104 is configured with an intermediate set of vanes 108. These intermediate vanes 108 are arranged circumferentially around the axis 70 in an annular array. Each intermediate vane 108 is circumferentially separated from each circumferentially adjacent (e.g., neighboring) intermediate vane 108 by a respective gap 110. The gaps 110 collectively form an intermediate airflow inlet 112 into the swirler 64; see also FIG. 3. The intermediate vanes 108 may be configured such that air entering the swirler 64 through the intermediate airflow inlet 112 generally flows in the first circumferential direction 96 (e.g., the clockwise direction) about the axis 70. Alternatively, referring to FIG. 5B, the intermediate vanes 108 may be configured such that air entering the swirler 64 through the intermediate airflow inlet 112 generally flows in the second circumferential direction 98 (e.g., the counterclockwise direction) about the axis 70. This circumferential direction for the intermediate vanes 108 may be the same as the circumferential direction for the upstream vanes 90. However, in other embodiments, the circumferential direction for the intermediate vanes 108 may be the opposite as the circumferential direction for the upstream vanes 90.

In the specific embodiment of FIG. 3, the intermediate vanes 108 are arranged at a joint between the swirler segments 76 and 77. With this arrangement, each gap 110 may extend partially axially into the intermediate swirler segment 77 from a castellated surface 114 of the segment at the to a gap end surface 116. Of course, in other embodiments, each gap may be formed completely axially within the swirler 64 and, for example, its intermediate swirler segment 77.

The swirler inner wall 82 projects out from the intermediate swirler segment base 104 and extends axially (in a downstream direction along the axis 70) to an annular distal inner wall end 118. As the swirler inner wall 82 extends towards the distal inner wall end 118, the swirler inner wall 82 may (e.g., smoothly and/or continuously) radially taper inwards towards the axis 70. The swirler inner wall 82 may thereby have a tubular conical geometry with tubular conical inner and outer wall surfaces 120 and 122. The swirler inner wall 82 and its distal end 118 are each disposed radially with and axially overlapped by the swirler outer wall 80.

The downstream swirler segment 78 includes an annular downstream swirler segment base 124 (e.g., a radial flange) and the swirler outer wall 80. The downstream swirler segment 78 and each of its components 80 and 124 extends circumferentially around the axis 70.

The downstream swirler segment base 124 is abutted axially against the intermediate swirler segment 77. The downstream swirler segment base 124, for example, may be coupled (e.g., bonded to) the intermediate swirler segment surface 106. The downstream swirler segment base 124 extends axially along the axis 70 from the intermediate swirler segment 77 to an annular downstream swirler segment surface 126.

Figure 6A:
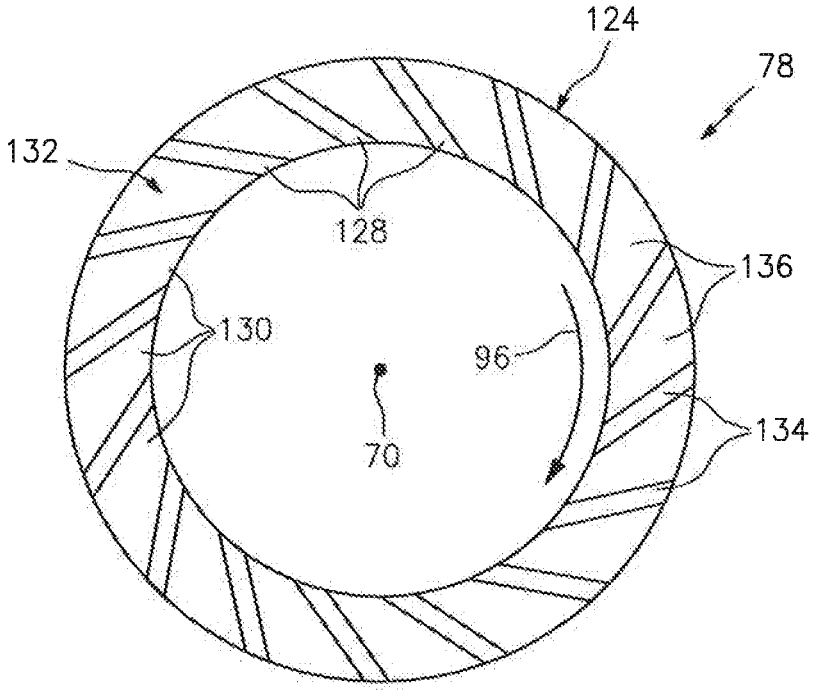
FIG. 6A is an end view illustration of a downstream swirler segment of the swirler with vanes arranged in the first circumferential direction.
Figure 6B:
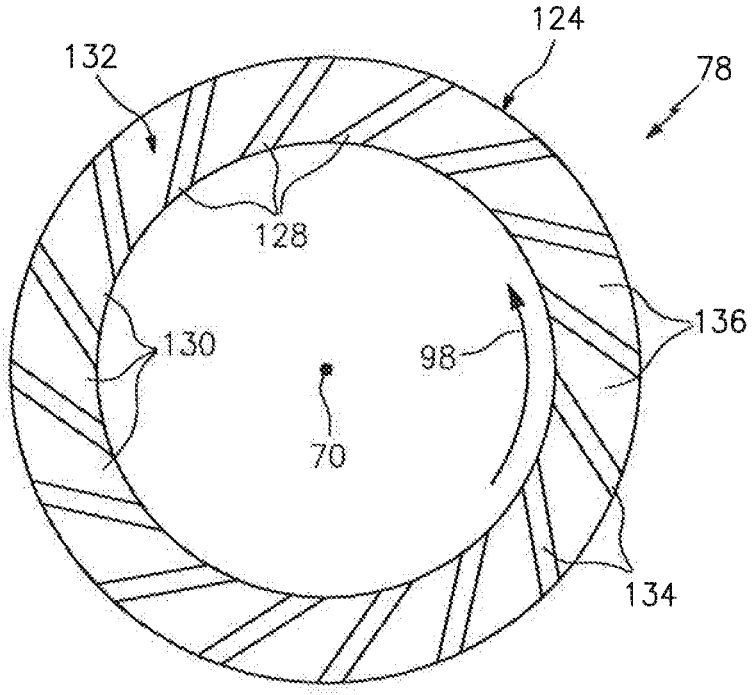
FIG. 6B is an end view illustration of the downstream swirler segment with the vanes arranged in the second circumferential direction.

Referring to FIG. 6A, the downstream swirler segment base 124 is configured with a downstream set of vanes 128. These downstream vanes 128 are arranged circumferentially around the axis 70 in an annular array. Each downstream vane 128 is circumferentially separated from each circumferentially adjacent (e.g., neighboring) downstream vane 128 by a respective gap 130. The gaps 130 collectively form a downstream airflow inlet 132 into the swirler 64; see also FIG. 3. The downstream vanes 128 may be configured such that air entering the swirler 64 through the downstream airflow inlet 132 generally flow in the first circumferential direction 96 (e.g., the clockwise direction) about the axis 70. Alternatively, referring to FIG. 6B, the downstream vanes 128 may be configured such that air entering the swirler 64 through the downstream airflow inlet 132 generally flows in the second circumferential direction 98 (e.g., the counterclockwise direction) about the axis 70. This circumferential direction for the downstream vanes 128 may be the same as the circumferential direction for the upstream vanes 90 and/or the intermediate vanes 108. However, in other embodiments, the circumferential direction for the downstream vanes 128 may be the opposite as the circumferential direction for the upstream vanes 90 and/or the intermediate vanes 108.

In the specific embodiment of FIG. 3, the downstream vanes 128 are arranged at a joint between the swirler segments 77 and 78. With this arrangement, each gap 130 may extend partially axially into the downstream swirler segment 78 from a castellated surface 134 of the segment at the to a gap end surface 136. Of course, in other embodiments, each gap 130 may be formed completely axially within the swirler 64 and, for example, its downstream swirler segment 78.

The swirler outer wall 80 projects out from the downstream swirler segment base 124 and extends axially (in the downstream direction along the axis 70) to an annular distal outer wall end 138. As the swirler outer wall 80 extends towards the distal outer wall end 138, the swirler outer wall 80 may (e.g., smoothly and/or continuously) radially taper inwards towards the axis 70. The swirler outer wall 80 may thereby have a generally tubular conical geometry with a tubular conical inner wall surface 140. The swirler outer wall 80 axially overlaps and circumscribes the swirler outer wall 80.

The swirler 64 is configured such that the distal inner wall end 118 and the distal outer wall end 138 are axially offset from one another along the axis 70. The distal inner wall end 118 of FIG. 3, for example, is axially recessed into the swirler 64 from the distal outer wall end 138. More particularly, the distal inner wall end 118 is disposed an axial distance (d) upstream of the distal outer wall end 138. The distal outer wall end 138 may thereby define a downstream most surface of the swirler 64; e.g., a dump plane of the swirler 64.

The inner passage 84 of FIG. 3 is an inner bore of the swirler 64. This inner passage 84 is formed radially within and by each of the swirler segments 76 and 77. The inner passage 84 is fluidly coupled with the upstream airflow inlet 94 and the intermediate airflow inlet 112. The inner passage 84 of FIG. 3 extends from the airflow inlets 94 and 112 to an inner nozzle outlet 142. This inner nozzle outlet 142 is defined by and radially within the swirler inner wall 82 at the distal inner wall end 118.

The outer passage 86 of FIG. 3 is an annular passage formed by the swirler segments 77 and 78. This outer passage 86 is formed radially between the swirler inner wall 82 and the swirler outer wall 80. The outer passage 86 is fluidly coupled with the downstream airflow inlet 132. The outer passage 86 of FIG. 3 extends from the downstream airflow inlet 132 to an outer nozzle outlet 144. This outer nozzle outlet 144 is defined by and radially between the swirler inner and outer walls 82 and 80 at their distal ends 118 and 138.

The outer passage 86 and its nozzle outlet 144 are configured with an inner diameter ($D_{sw\text{-}ex}$) at the distal outer wall end 138. This diameter ($D_{sw\text{-}ex}$) is measured from, for example, the inner wall surface 140 of the swirler outer wall 80 on a corner between that surface 140 and an annular distal outer wall end surface 146.

Referring to FIG. 2, the swirler 64 is mated with the bulkhead 62. In particular, the swirler inner and outer walls 82 and 80 project axially into or through a respective aperture 148 in the bulkhead 62. The swirler 64 is mounted to the bulkhead 62. The downstream swirler segment 78, for example, may be bonded (e.g., brazed or welded) and/or otherwise connected to the bulkhead 62 and, for example, a shell 150 of the bulkhead 62.

The fuel injector 66 includes a fuel injector stem 152 and a fuel injector nozzle 154. The fuel injector stem 152 is configured to support and route fuel to the fuel injector nozzle 154. The fuel injector nozzle 154 is cantilevered from the fuel injector stem 152, and projects along the axis 70 partially into the inner bore of the swirler 64. A tip 156 of the fuel injector nozzle 154 is thereby disposed within the inner passage 84.

Figure 7:
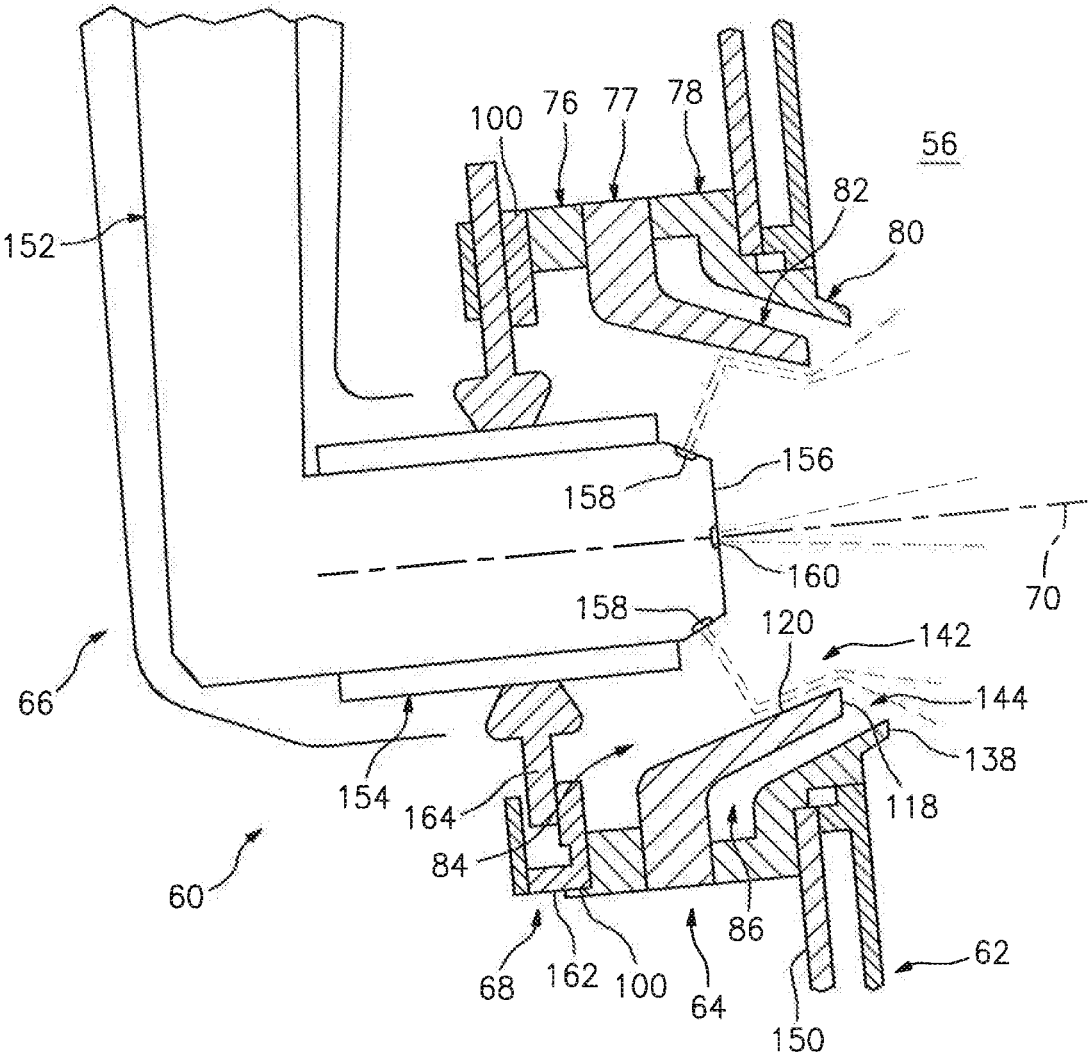
FIG. 7 is a partial side sectional illustration of the swirler mated with a fuel nozzle and a combustor bulkhead.
Figure 8:
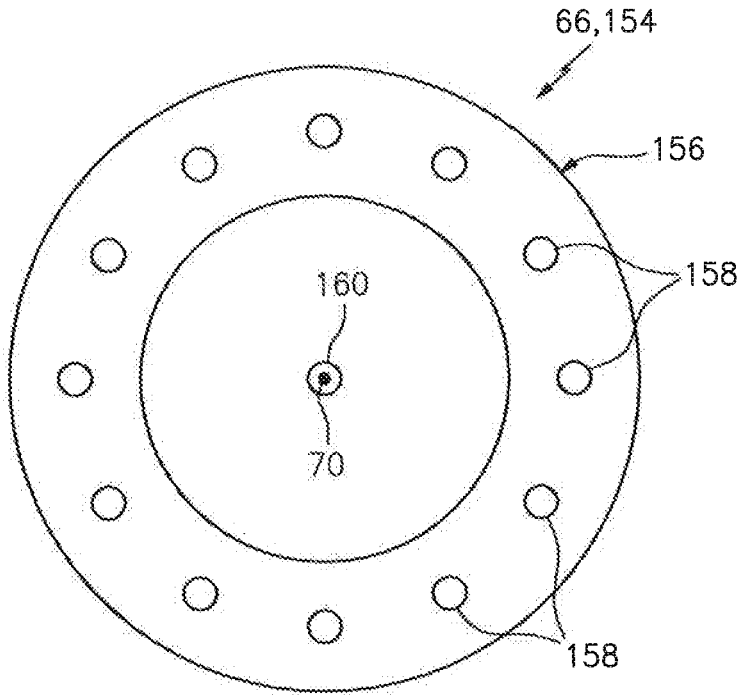
FIG. 8 is an end view illustration of a tip of the fuel nozzle.

Referring to FIG. 7, the fuel injector nozzle 154 includes a plurality of nozzle orifices 158 arranged circumferentially about the axis 70 in an annular array; see also FIG. 8. These nozzle orifices 158 may be axially aligned with (e.g., axially overlapped by) the swirler inner wall 82 and its inner wall surface 120. One or more or each of these nozzle orifices 158 is configured to direct a jet of fuel to impinge against the swirler inner wall 82 and its inner wall surface 120.

The fuel injector nozzle 154 may also include a central nozzle orifice 160; see also FIG. 8. This central nozzle orifice 160 may be coaxial with the axis 70 and thereby centrally located between the nozzle orifices 158. The central nozzle orifice 160 is configured to direct a jet of fuel along the axis 70, through the inner nozzle outlet 142, and into the combustion chamber 56. A quantity of fuel provided by this central nozzle orifice 160 may be less than a collective quantity of fuel provided by the nozzle orifices 158; however, the present disclosure is not limited to such a relationship.

The mount 68 is configured to couple the fuel injector nozzle 154 to the swirler 64. The mount 68 of FIG. 7, for example, includes a mount base 162 and a nozzle guide plate 164. The mount base 162 is connected (e.g., bonded) to the upstream swirler segment 76 and, for example, to its castellated surface 100. The mount base 162 is configured to capture the nozzle guide plate 164 in such a fashion that the nozzle guide plate 164 may float, to a limited degree, relative to the swirler 64. The nozzle guide plate 164 in turn is mated with the fuel injector nozzle 154. The fuel injector nozzle 154, for example, projects through a bore in the nozzle guide plate 164. The bore is sized such that the fuel injector nozzle 154 may slide axially along the axis 70 relative to the nozzle guide plate 164. The mount 68 thereby may (e.g., loosely) couple and locate the fuel injector nozzle 154 to the swirler while enabling for slight shifts due to differential thermal expansion as well as vibrations.

During operation of the fuel injector assembly 60 of FIG. 7, the nozzle orifices 158 direct the jets of fuel to impinge against the swirler inner wall 82. Upon hitting the inner wall surface 120, the swirling air introduced into the inner passage 84 form the airflow inlets 94 and 112 (see FIG. 3) may cause the fuel from the jets to form a thin film of fuel on the inner wall surface 120. This film of fuel travels along the inner wall surface 120 towards the inner nozzle outlet 142. At the inner nozzle outlet 142, the film of fuel separates from the swirler inner wall 82 and is acted upon by swirling air exiting both the inner nozzle outlet 142 and the outer nozzle outlet 144. The air may exit the nozzle outlets 142 and 144 at different speeds and thereby subject the separated fuel to a shear force. This shear force may cause the separated fuel to break up and atomize for combustion within the combustion chamber 56.

Atomization quality may depend upon a thickness of the film of fuel as well as a velocity and swirl of the air from the inner and the outer passages 84 and 86. The thickness of the film of fuel may depend upon an amount of fuel injected by the nozzle orifices 158 onto the swirler inner wall 82 and a length of travel along the swirler inner wall 82. Therefore, in general, decreasing the length of travel of the film of fuel along the swirler inner wall 82 may result in a thinner film thickness. Thus, the distal inner wall end 118 is positioned forward of the distal outer wall end 138 as described above. By providing a thinner film thickness, the fuel injector assembly 60 of the present disclosure may be operable to facilitate improved fuel and air mixing and/or a reduction in combustion dynamics.

Figure 9:
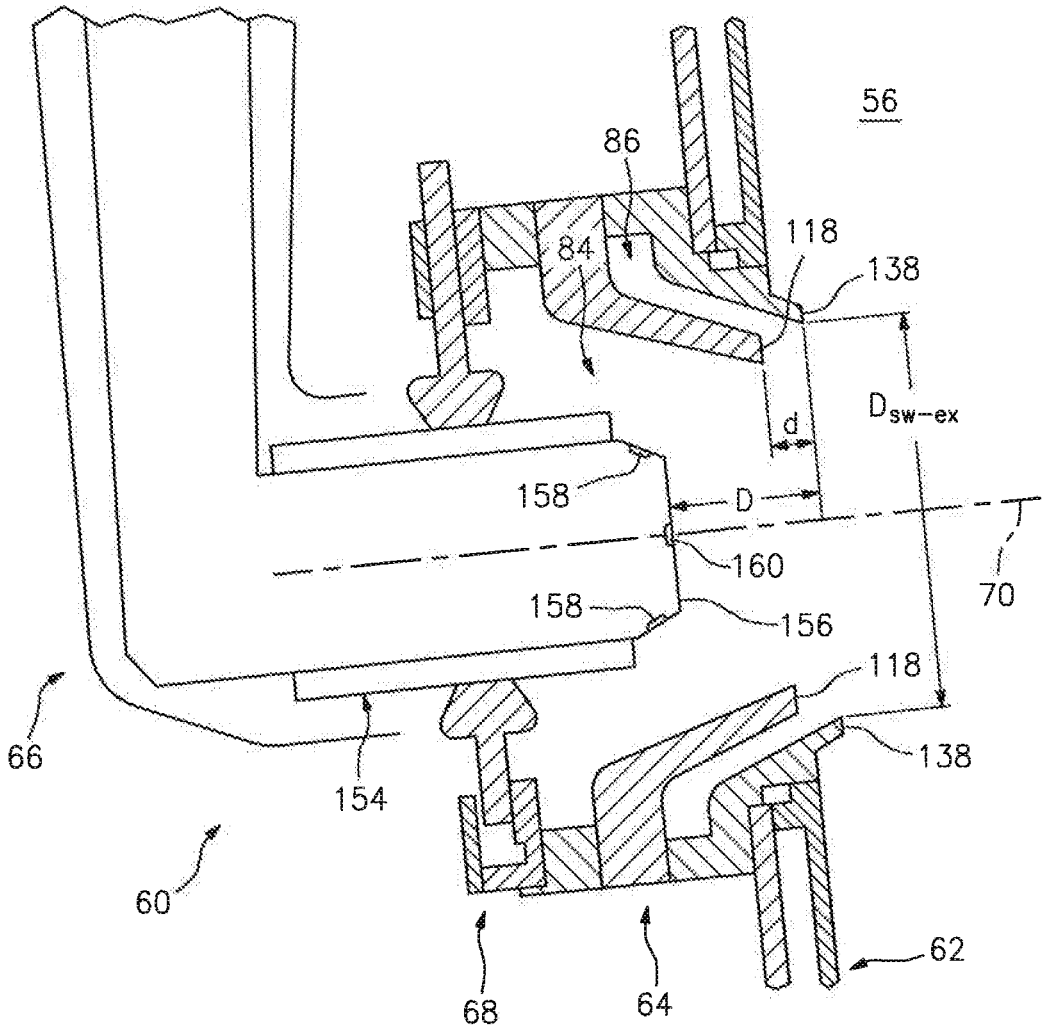
FIG. 9 is another partial side sectional illustration of the swirler mated with the fuel nozzle and the combustor bulkhead.

Referring to FIG. 9, the tip 156 of the fuel injector nozzle 154 is disposed an axial distance (D) along the axis 70 from the distal outer wall end 138. By minimizing the equation $(D-d)/D_{sw\text{-}ex}$, by decreasing the equation $D/D_{sw\text{-}ex}$ and/or by increasing the equation $d/D_{sw\text{-}ex}$, it has been found that combustion tones within the combustion chamber 56 may be reduced. For example, the fuel injector assembly 60 may be configured such that the equation $(D-d)/D_{sw\text{-}ex}$ is less than or equal to one (e.g., less than 0.80) and/or greater than or equal to 0.25 (e.g., greater than 0.30). The fuel injector assembly 60, for example, may be configured such that the equation $(D-d)/D_{sw\text{-}ex}$ is between 0.35 and 0.68.

The fuel injector assembly 60 may be configured such that the equation $D/D_{sw\text{-}ex}$ is less than or equal to one and/or greater than or equal to 0.40. The fuel injector assembly 60, for example, may be configured such that the equation $D/D_{sw\text{-}ex}$ is between 0.50 and 0.75.

The fuel injector assembly 60 may be configured such that the equation $d/D_{sw\text{-}ex}$ is less than or equal to 0.20 and/or greater than or equal to 0.05. The fuel injector assembly 60, for example, may be configured such that the equation $d/D_{sw\text{-}ex}$ is between 0.07 and 0.15.

The swirler 64 is described above with a multi-segment body, where each segment 76-78 may be discretely formed and subsequently connected (e.g., bonded and/or mechanically fastened) to the other segment(s). However, in other embodiments, the swirler 64 may be configured such that any two or all of the segments 76-78 are formed integrally together as a unitary, monolithic body via, for example, casting and/or additive manufacturing.

In some embodiments, the swirler 64 may be configured with two airflow inlets. The swirler 64, for example, may be configured without the upstream swirler segment 76. In still other embodiments, the swirler 64 may be configured with more than three airflow inlets.

The fuel injector assembly 60 may be included in various turbine engines other than the one described above as well as in other types of fuel powered equipment. The fuel injector assembly 60, for example, may be included in a geared turbine engine where a gear train connects one or more shafts to one or more rotors in a fan section, a compressor section and/or any other engine section. Alternatively, the fuel injector assembly 60 may be included in a turbine engine configured without a gear train. The fuel injector assembly 60 may be included in a geared or non-geared turbine engine configured with a single spool, with two spools (e.g., see FIG. 1), or with more than two spools. The turbine engine may be configured as a turbofan engine, a turbojet engine, a propfan engine, a pusher fan engine or any other type of turbine engine. The present disclosure therefore is not limited to any particular types or configurations of turbine engines or equipment.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:
- a swirler configured with an outer wall, an inner wall, an outer passage and an inner passage;
- the outer wall circumscribing the inner wall and extending axially along an axis to a distal outer wall end;
- the inner wall extending axially along the axis to a distal inner wall end that is axially recessed within the swirler from the distal outer wall end;
- the outer passage formed by and radially between the inner wall and the outer wall;
- the inner passage formed by and radially within the inner wall; and
- a fuel nozzle projecting into the inner passage, the fuel nozzle configured with a plurality of orifices axially aligned with the inner wall and arranged circumferentially about the axis in an annular array, and the fuel nozzle configured with a central nozzle orifice arranged coaxial with the axis;
- wherein the distal outer wall end is disposed a first distance along the axis from a tip of the fuel nozzle;
- wherein the distal outer wall end is disposed a second distance along the axis from the distal inner wall end;
- wherein the outer passage has a diameter at the distal outer wall end;
- wherein a first value is equal to the first distance minus the second distance; and
- wherein a quotient of the first value divided by the diameter is less than one.

2. The assembly of claim 1, wherein the plurality of orifices include a first orifice that is configured to direct a jet of fuel to impinge against the inner wall.

3. The assembly of claim 1, wherein the quotient is less than or equal to 0.8.

4. The assembly of claim 1, wherein the quotient is greater than or equal to 0.25.

5. The assembly of claim 1, wherein the quotient is between 0.35 and 0.68.

6. The assembly of claim 1, wherein
- the swirler includes a first set of vanes and a second set of vanes;
- the first set of vanes are arranged with the outer passage; and
- the second set of vanes are arranged with the inner passage.

7. The assembly of claim 1, further comprising a nozzle guide plate mounting the fuel nozzle to the swirler.

8. An assembly for a turbine engine, comprising:
- a swirler configured with an outer wall, an inner wall, an outer passage and an inner passage;
- the outer wall circumscribing the inner wall and extending axially along an axis to a distal outer wall end;
- the inner wall extending axially along the axis to a distal inner wall end that is axially recessed within the swirler from the distal outer wall end;
- the outer passage formed by and radially between the inner wall and the outer wall;
- the inner passage formed by and radially within the inner wall; and
- a fuel nozzle projecting into the inner passage, the fuel nozzle configured with a plurality of orifices axially aligned with the inner wall and arranged circumferentially about the axis in an annular array, and the fuel nozzle configured with a central nozzle orifice arranged coaxial with the axis;
- wherein the distal outer wall end is disposed a distance along the axis from a tip of the fuel nozzle;
- wherein the outer passage has a diameter at the distal outer wall end; and
- wherein a quotient of the distance divided by the diameter is less than one.

9. The assembly of claim 8, wherein the quotient is between 0.5 and 0.75.

10. An assembly for a turbine engine, comprising:
- a swirler configured with an outer wall, an inner wall, an outer passage and an inner passage;
- the outer wall circumscribing the inner wall and extending axially along an axis to a distal outer wall end;
- the inner wall extending axially along the axis to a distal inner wall end that is axially recessed within the swirler from the distal outer wall end;
- the outer passage formed by and radially between the inner wall and the outer wall;
- the inner passage formed by and radially within the inner wall; and
- a fuel nozzle projecting into the inner passage, the fuel nozzle configured with a plurality of orifices axially aligned with the inner wall and arranged circumferentially about the axis in an annular array, and the fuel nozzle configured with a central nozzle orifice arranged coaxial with the axis;
- wherein the distal outer wall end is disposed a first distance along the axis from a tip of the fuel nozzle;
- wherein the distal outer wall end is disposed a second distance along the axis from the distal inner wall end;

wherein the outer passage has a diameter at the distal outer wall end; and wherein a quotient of the second distance divided by the diameter is between 0.07 and 0.15.

11. An assembly for a turbine engine, comprising:

a swirler configured with an outer wall, an inner wall, an outer passage and an inner passage;

the outer wall circumscribing the inner wall and extending axially along an axis to a distal outer wall end;

the inner wall extending axially along the axis to a distal inner wall end that is axially recessed within the swirler from the distal outer wall end;

the outer passage formed by and radially between the inner wall and the outer wall;

the inner passage formed by and radially within the inner wall; and a fuel nozzle projecting into the inner passage, the fuel nozzle configured with a plurality of orifices axially aligned with the inner wall and arranged circumferentially about the axis in an annular array, and the fuel nozzle configured with a central nozzle orifice arranged coaxial with the axis;

wherein the swirler includes a first set of vanes and a second set of vanes;

wherein the first set of vanes are arranged with the outer passage;

wherein the second set of vanes are arranged with the inner passage;

wherein the swirler further includes a third set of vanes arranged with the inner passage; and wherein the third set of vanes are axially offset from the second set of vanes.

12. A fuel injector assembly with an axis, comprising:

a swirler configured with an outer wall, an inner wall, an outer passage and an inner passage;

the outer wall extending circumferentially about the inner wall and extending axially along the axis to a distal outer wall end;

the inner wall extending axially along the axis to a distal inner wall end;

the outer passage radially between the inner wall and the outer wall;

the inner passage radially within the inner wall; and a fuel nozzle projecting into the inner passage;

wherein the distal outer wall end is disposed a first distance along the axis from a tip of the fuel nozzle, the distal outer wall end is disposed a second distance along the axis from the distal inner wall end, and the outer passage has a diameter at the distal outer wall end;

wherein a first value is equal to the first distance minus the second distance;

wherein a quotient of the first value divided by the diameter is less than one; and wherein the quotient is between 0.35 and 0.68.

13. The fuel injector assembly of claim 12, wherein the fuel nozzle is configured with a plurality of orifices that are axially overlapped by the inner wall and arranged circumferentially about the axis.

* * * * *